US006938983B2

(12) United States Patent
Silverbrook

(10) Patent No.: US 6,938,983 B2
(45) Date of Patent: Sep. 6, 2005

(54) SUPPORT MEMBER WITH CORE AND SHELL

(75) Inventor: Kia Silverbrook, Balmain (AU)

(73) Assignee: Silverbrook Research PTY LTD, Balmain (AU)

( * ) Notice: Subject to any disclaimer, the term of this patent is extended or adjusted under 35 U.S.C. 154(b) by 0 days.

(21) Appl. No.: 10/882,770

(22) Filed: Jul. 2, 2004

(65) Prior Publication Data

US 2004/0239724 A1 Dec. 2, 2004

Related U.S. Application Data

(63) Continuation of application No. 10/713,089, filed on Nov. 17, 2003, now Pat. No. 6,799,836, which is a continuation of application No. 10/129,503, filed as application No. PCT/AU01/00239 on Mar. 6, 2001, now Pat. No. 6,676,245.

(30) Foreign Application Priority Data

Mar. 6, 2000 (AU) ..... PQ6058
Mar. 6, 2000 (AU) ..... PG6058

(51) Int. Cl.[7] ..... B41J 2/155
(52) U.S. Cl. ..... 347/42

(58) Field of Search ..... 347/42, 40, 5, 347/7, 9, 1, 20, 54, 68, 69, 70, 71, 72, 50, 44, 47, 27, 63

(56) References Cited

U.S. PATENT DOCUMENTS 6,270,196 B1 8/2001 Uno et al.
2004/0095414 A1 * 5/2004 Silverbrook ..... 347/20

FOREIGN PATENT DOCUMENTS

JP 10157105 A 6/1998
JP 11010861 A 1/1999
JP 2000263768 A 9/2000

* cited by examiner

*Primary Examiner*—Raquel Yvette Gordon

(57) ABSTRACT

A support member (3) that can be secured in the printer, and a printhead (2) that can be mounted to the support member. The support member has a core with at least one ink reservoir (6, 7, 8 and 9) enclosed within a laminated shell (4). The materials and structure of the shell (4) and the core (5) are selected and configured so that the co-efficient of thermal expansion of the support member as a whole is substantially equal to that of the printhead (2).

13 Claims, 1 Drawing Sheet

SUPPORT MEMBER WITH CORE AND SHELL

CROSS REFERENCE TO RELATED APPLICATIONS

This is a Continuation Application of U.S. application Ser. No. 10/713,089, filed on Nov. 17, 2003, now Issued U.S. Pat. No. 6,799,836, which is a Continuation of U.S. application Ser. No. 10/129,503, filed on May 6, 2002, now Issued U.S. Pat. No. 6,676,245, which is a 371 of PCT/AU01/00239, filed on Mar. 6, 2001, all of which are herein incorporated by reference.

FIELD OF THE INVENTION

The present invention relates to printers, and in particular to digital inkjet printers.

CO-PENDING APPLICATIONS

Various methods, systems and apparatus relating to the present invention are disclosed in the following co-pending applications filed by the applicant or assignee of the present invention on 24 May 2000:

| | | | |
|---|---|---|---|
| PCT/AU00/00578 | PCT/AU00/00579 | PCT/AU00/00581 | PCT/AU00/00580 |
| PCT/AU00/00582 | PCT/AU00/00587 | PCT/AU00/00588 | PCT/AU00/00589 |
| PCT/AU00/00583 | PCT/AU00/00593 | PCT/AU00/00590 | PCT/AU00/00591 |
| PCT/AU00/00592 | PCT/AU00/00584 | PCT/AU00/00585 | PCT/AU00/00586 |
| PCT/AU00/00594 | PCT/AU00/00595 | PCT/AU00/00596 | PCT/AU00/00597 |
| PCT/AU00/00598 | PCT/AU00/00516 | PCT/AU00/00517 | PCT/AU00/00511 |

Various methods, systems and apparatus relating to the present invention are disclosed in the following co-pending application, PCT/AU00/01445 filed by the applicant or assignee of the present invention on 27 Nov. 2000. The disclosures of these co-pending applications are incorporated herein by cross-reference. Also incorporated by cross-reference, is the disclosure of a co-filed PCT application, PCT/AU01/00238 (deriving priority from Australian Provisional Patent Application No. PQ6059).

BACKGROUND OF THE INVENTION

Recently, inkjet printers have been developed which use printheads manufactured by micro-electro mechanical system(s) (MEMS) techniques. Such printheads have arrays of microscopic ink ejector nozzles formed in a silicon chip using MEMS manufacturing techniques.

Printheads of this type are well suited for use in pagewidth printers. Pagewidth printers have stationary printheads that extend the width of the page to increase printing speeds. Pagewidth printheads do not traverse back and forth across the page like conventional inkjet printheads, which allows the paper to be fed past the printhead more quickly.

To reduce production and operating costs, the printheads are made up of separate printhead modules mounted adjacent each other on a support beam in the printer. To ensure that there are no gaps or overlaps in the printing produced by adjacent printhead modules it is necessary to accurately align the modules after they have been mounted to the support beam. Once aligned, the printing from each module precisely abuts the printing from adjacent modules.

Unfortunately, the alignment of the printhead modules at ambient temperature will change when the support beam expands as it heats up during printhead operation. Furthermore, if the printhead modules are accurately aligned when the support beam is at the equilibrium operating temperature, there may be unacceptable misalignments in any printing before the beam has reached the operating temperature. Even if the printhead is not modularized, thereby making the alignment problem irrelevant, the support beam and printhead may bow because of different thermal expansion characteristics. Bowing across the lateral dimension of the support beam does little to affect the operation of the printhead. However, as the length of the beam is its major dimension, longitudinal bowing is more significant and can affect print quality.

SUMMARY OF THE INVENTION

According to one aspect of the invention, there is provided a support member configured to be secured within a pagewidth printhead assembly so as to support a modular pagewidth printhead formed from one or more silicon structures, the support member comprising:

an outer laminated shell portion; and a core portion, at least partially enclosed and restrained by the shell portion, wherein the shell portion and the printhead have substantially the same effective coefficient of thermal expansion.

According to another aspect of the invention, there is provided a printhead assembly for a digital inkjet printer, the printhead assembly including:

a support member for attachment to the printer;

a printhead adapted for mounting to the support member;

the support member having an outer shell and a core element defining at least one ink reservoir such that the effective coefficient of thermal expansion of the support member is substantially equal to the coefficient of thermal expansion of the printhead.

Preferably, the outer shell is formed from at least two different metals laminated together and the printhead includes a silicon MEMS chip. In a further preferred form, the support member is a beam and the core element is a plastic extrusion defining four separate ink reservoirs. In a particularly preferred form, the metallic outer shell has an odd number of longitudinally extending layers of at least two different metals, wherein layers of the same metal are symmetrically disposed about the central layer.

It will be appreciated that by laminating layers of uniform thickness of the same material on opposite sides of the central layer, and at equal distances therefrom, there is no tendency for the shell to bow because of a dominating effect from any of the layers. However, if desired, bowing can also be eliminated by careful design of the shells cross section and variation of the individual layer thicknesses.

In some embodiments, the printhead is a plurality of printhead modules positioned end to end along the beam.

BRIEF DESCRIPTION OF THE DRAWING

A preferred embodiment of the invention will now be described, by way of example only, with reference to the accompanying drawing in which.

DETAILED DESCRIPTION OF THE PREFERRED EMBODIMENTS

Figure 1:
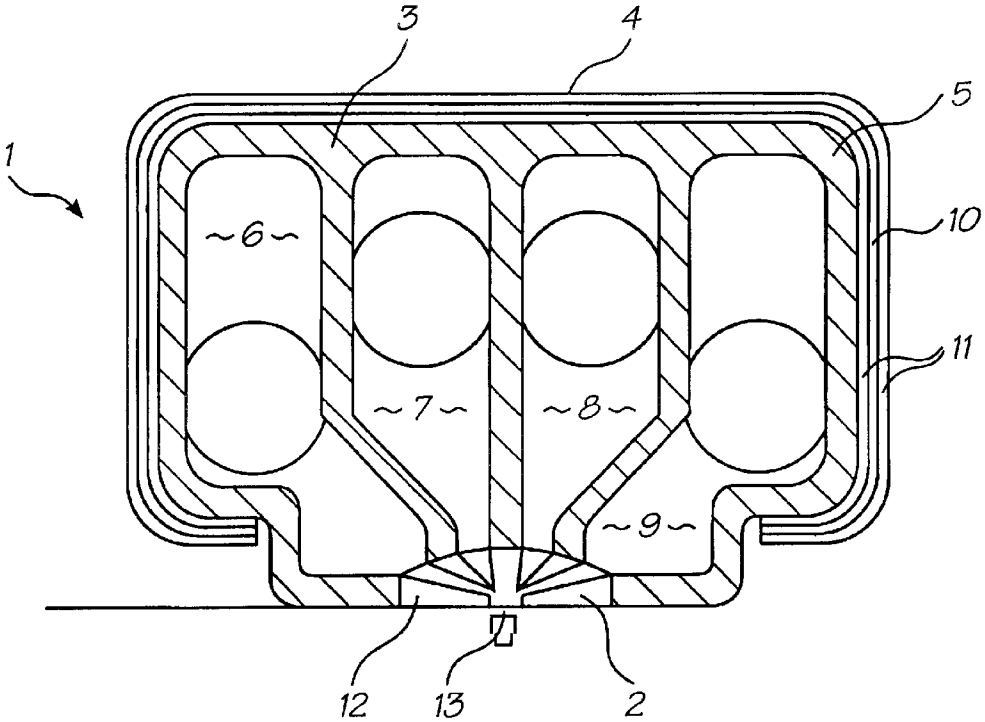
FIG. 1 is a schematic cross section of a printhead assembly according to the present invention.

Referring to the FIGURE, the printhead assembly 1 includes a printhead 2 mounted to a support member 3. The support member 3 has an outer shell 4 and a core element 5 defining four separate ink reservoirs 6, 7, 8 and 9. The outer shell 4 is a hot rolled trilayer laminate of two different metals. The first metal layer 10 is sandwiched between layers of the second metal 11. The metals forming the trilayer shell are selected such that the effective coefficient of thermal expansion of the shell as a whole is substantially equal to that of silicon even though the coefficients of the core and the individual metals may significantly differ from that of silicon. Provided that the core or one of the metals has a coefficient of thermal expansion greater than that of silicon, and another has a coefficient less than that of silicon, the effective coefficient can be made to match that of silicon by using different layer thicknesses in the laminate.

Typically, the outer layers 11 are made of invar which has a coefficient of thermal expansion of $1.3\times10^{-6}$ m/° C. The coefficient of thermal expansion of silicon is about $2.5\times10^{-6}$ m/° C. and therefore the central layer must have a coefficient greater than this to give the support beam an overall effective coefficient substantially the same as silicon.

The printhead 2 includes a micro moulding 12 that is bonded to the core element 5. A silicon printhead chip 13 constructed using MEMS techniques provides the ink nozzles, chambers and actuators.

As the effective coefficient of thermal expansion of the support beam is substantially equal to that of the silicon printhead chip, the distortions in the printhead assembly will be minimized as it heats up to operational temperature. Accordingly, if the assembly includes a plurality of aligned printhead modules, the alignment between modules will not change significantly. Furthermore, as the laminated structure of the outer shell is symmetrical in the sense that different metals are symmetrically disposed around a central layer, there is no tendency of the shell to bow because of greater expansion or contraction of any one metal in the laminar structure. Of course, a non-symmetrical laminar structure could also be prevented from bowing by careful design of the lateral cross section of the shell.

The invention has been described herein by way of example only. Skilled workers in this field will readily recognise that the invention may be embodied in many other forms.

What is claimed is:

1. A support member configured to be secured within a pagewidth printhead assembly so as to support a modular pagewidth printhead formed from one or more silicon structures, the support member comprising:

an outer laminated shell portion; and a core portion, at least partially enclosed and restrained by the shell portion, wherein the shell portion and the printhead have substantially the same effective coefficient of thermal expansion.

2. A support member according to claim 1, wherein:

the pagewidth printhead is stationary and generally as long as the page width.

3. A support member according to claim 2, wherein:

the shell portion is a laminated structure having an odd number of longitudinally extending continuous layers of at least two different metals wherein at least some of the layers are in a symmetrical arrangement.

4. A support member according to claim 1, wherein:

the core portion has formed in it one or more ink reservoirs which collectively lead to one or more printhead micro mouldings which are carried by the core.

5. A support member according to claim 1, wherein:

the laminated shell portion is formed from at least three metals laminated together, the laminate having inner and outer layers which have the same coefficient of thermal expansion.

6. A support member according to claim 1, wherein:

the printhead is fabricated from silicon and constructed using micro electromechanical techniques.

7. A support member according to claim 1, wherein:

the core portion is an extrusion in which is formed separate ink reservoirs.

8. A support member according to claim 1, wherein:

the modular printhead comprises MEMS modules which are positioned end to end along the core.

9. A support member according to claim 8, wherein:

each module further comprises ink nozzles, chambers and actuators.

10. A support member according to claim 1, wherein:

the laminated shell portion comprises two or more different materials, each having a different coefficient of thermal expansion.

11. A support member according to claim 10, wherein:

at least two materials have coefficients of expansion which are different than the coefficient of expansion of silicon.

12. A support member according to claim 11, wherein:

the laminated shell portion comprises outer layers of invar.

13. A support member according to claim 1, wherein:

the shell portion has a composite coefficient of expansion generally equal to the coefficient of expansion silicon.

* * * * *

UNITED STATES PATENT AND TRADEMARK OFFICE

CERTIFICATE OF CORRECTION

PATENT NO. : 6,938,983 B2 
DATED : September 13, 2005
INVENTOR(S) : Kia Silverbrook It is certified that error appears in the above-identified patent and that said Letters Patent is hereby corrected as shown below:

Title page,
Item [30], should read:
-- [30] Foreign Application Priority Data
March 6, 2000 (AU)……...PQ6058 --.

Signed and Sealed this

Sixth Day of December, 2005

JON W. DUDAS
*Director of the United States Patent and Trademark Office*

UNITED STATES PATENT AND TRADEMARK OFFICE

CERTIFICATE OF CORRECTION

PATENT NO. : 6,938,983 B2
DATED : September 13, 2005
INVENTOR(S) : Kia Silverbrook It is certified that error appears in the above-identified patent and that said Letters Patent is hereby corrected as shown below:

Title page,
Item [30], Foreign Application Priority Data, should read:
-- March 6, 2000 (AU)……...PQ6058 --.

Signed and Sealed this

Twentieth Day of December, 2005

JON W. DUDAS
*Director of the United States Patent and Trademark Office*

UNITED STATES PATENT AND TRADEMARK OFFICE

CERTIFICATE OF CORRECTION

PATENT NO. : 6,938,983 B2
DATED : September 6, 2005
INVENTOR(S) : Kia Silverbrook It is certified that error appears in the above-identified patent and that said Letters Patent is hereby corrected as shown below:

Title page,
Item [30], Foreign Application Priority Data, should read:
-- March 6, 2000 (AU)……PQ6058 --.

This certificate supersedes Certificate of Correction issued December 6, 2005 and December 20, 2005.

Signed and Sealed this

Seventh Day of February, 2006

JON W. DUDAS
*Director of the United States Patent and Trademark Office*